US006392471B1

(12) United States Patent
Tomasini et al.

(10) Patent No.: US 6,392,471 B1
(45) Date of Patent: May 21, 2002

(54) VOLTAGE GENERATOR IN A MOS INTEGRATED CIRCUIT

(75) Inventors: Luciano Tomasini, Monza; Jesus Guinea, Brembate; Rinaldo Castello, Agrate, all of (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 09/766,890

(22) Filed: Jan. 19, 2001

(51) Int. Cl.[7] ..... G05F 1/10
(52) U.S. Cl. ..... 327/541
(58) Field of Search ..... 327/530, 534, 327/535, 537, 538, 539, 540, 541, 542, 543, 545, 546

(56) References Cited

U.S. PATENT DOCUMENTS 4,893,091 A * 1/1990 Lillis et al. ..... 330/253
5,534,817 A * 7/1996 Suzuki et al. ..... 327/541
5,682,117 A * 10/1997 Choi et al. ..... 327/530

* cited by examiner

*Primary Examiner*—Jeffrey Zweizig
(74) *Attorney, Agent, or Firm*—Lisa K. Jorgenson; Allen, Dyer, Doppelt, Milsbrath & Gilchrist, P.A.

(57) ABSTRACT

The generator includes complementary MOS transistors interconnected in four circuit branches one of which contains a constant-current generator. Voltages picked up at various nodes of the circuit can be used as reference and/or biasing voltages of the integrated circuit, which account for the variability of the manufacturing parameters.

18 Claims, 2 Drawing Sheets

VOLTAGE GENERATOR IN A MOS INTEGRATED CIRCUIT

FIELD OF THE INVENTION

The present invention relates to integrated circuits and, more particularly, to a voltage generator for use in a MOS integrated circuit.

BACKGROUND OF THE INVENTION

As is known, during the manufacture of integrated circuits, some electrical quantities cannot be determined precisely at the design stage because they depend on manufacturing parameters which may vary randomly, although within statistically predictable limits. In other words, the same electrical quantity, for example, the gate-source voltage of a conducting MOS transistor, may have different values in different specimens of the same integrated circuit. This variability is a problem which becomes more serious with lower supply voltages of the integrated circuit. Since, in the design of integrated circuits, there is a tendency to reduce the dimensions of the transistors and consequently to reduce the supply voltage, the problem is experienced to an ever greater extent.

In integrated circuits, it is sometimes necessary to provide reference and/or biasing voltages which take account of this variability of the manufacturing process, that is, which are not a predetermined fraction of the supply voltage of the integrated circuit but which depend on the actual value of one or more electrical quantities dependent on the manufacturing parameters. According to the prior art, it is possible to produce current generators which are substantially independent of variations of the manufacturing parameters, but it is not possible to produce voltage generators having the same independence.

SUMMARY OF THE INVENTION

An object of the present invention is to provide voltage generators which are substantially independent of variations of the manufacturing parameters.

This and other objects and advantages are achieved by the generator including complementary MOS transistors interconnected in four circuit branches one of which contains a constant-current generator. Voltages picked up at various nodes of the circuit can be used as reference and/or biasing voltages of the integrated circuit, which account for the variability of the manufacturing parameters.

BRIEF DESCRIPTION OF THE DRAWINGS

The invention will be understood better from the following detailed description of a non-limiting embodiment thereof, given with reference to the appended drawings, in which.

DETAILED DESCRIPTION OF THE PREFERRED EMBODIMENTS

Figure 1:
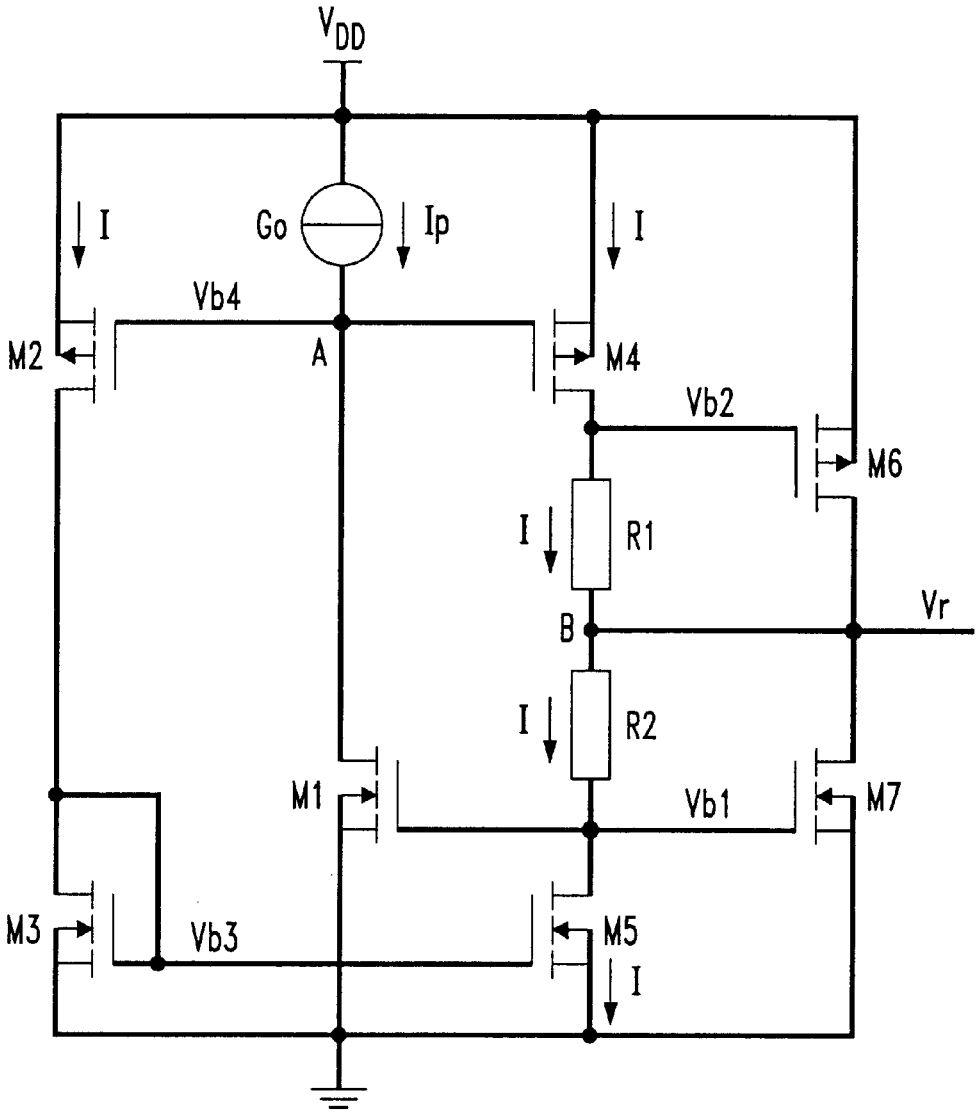
FIG. 1 is a circuit diagram of a generator according to the present invention.

The circuit of FIG. 1 substantially includes four interconnected branches. In particular, a first branch comprises an n-channel MOS transistor M1 having its drain terminal connected, via a constant-current generator Go, to a first supply terminal, indicated VDD, its source terminal connected to the second supply terminal, indicated by the ground symbol, and its gate terminal connected to another branch of the circuit which will be described below. The generator Go is preferably a generator of a current of predetermined value independent of the process variations and of temperature, for example, such as that shown in FIG. 2, which will be described below.

A second branch comprises a p-channel MOS transistor M2 and an n-channel MOS transistor M3 having their drain terminals connected to one another and their source terminals connected to the first supply terminal (VDD) and to the second supply terminal (ground), respectively. The transistor M2 has its gate terminal connected to a junction node A between the transistor M1 and the current generator Go and the transistor M3 has its gate terminal connected to its drain terminal and to a third circuit branch.

The third branch comprises a p-channel MOS transistor M4 and an n-channel MOS transistor M5 having their drain terminals connected to one another via two resistors R1 and R2 in series with one another, and their source terminals connected to the first supply terminal (VDD) and to the second supply terminal (ground), respectively. Moreover, the transistor M4 has its gate terminal connected to the node A and the transistor M5 has its gate terminal connected to the gate terminal of the transistor M3.

A fourth circuit branch comprises a p-channel MOS transistor M6 and an n-channel MOS transistor M7 having their drain terminals connected together to a junction node B between the two resistors R1 and R2, their source terminals connected to the first supply terminal (VDD) and to the second supply terminal (ground), respectively, and their gate terminals connected to the drain terminal of the transistor M4 and to the drain terminal of the transistor M5, respectively.

The terminals of the circuit at which a reference and/or biasing voltage can be picked up are the node B (voltage Vr), the gate terminals of the transistors M7 and M6 (voltages Vb1, Vb2) and the gate terminals of the transistors M3 and M2 (voltages (Vb3, Vb4).

The operation of the circuit will now be considered. If the gate currents are ignored, the current Ip forced by the generator Go at the node A is equal to the drain current of the transistor M1. The voltage of the node A adopts a constant value (determined by the voltage VgsM1 between the gate and the source of the transistor M1) which is applied to the gate terminals of the transistors M2 and M4. Since the transistors M2 and M4 have the same voltage Vgs between their gates and their sources, and assuming they have the same dimensions, the same current I passes through them. Clearly, the current I also passes through the transistor M3. Since the transistor M5 has the same Vgs voltage as the transistor M3, and assuming it has the same dimensions as M3, the current I also passes through the transistor M5.

Again ignoring the gate currents, it can be seen that the current I also passes through the resistor R2. Since the same current I passes through the resistor R1, no current passes from the node B to the drain terminals of the transistors M6 and M7. Moreover, equal currents pass through the latter transistors M6 and M7.

The voltage Vr at the node B will now be examined. It can be regarded as the voltage between the drain and the source of the transistor M7, that is:

$$Vr=VdsM7=I\cdot R2+VgsM7 \quad (1)$$

or as the difference between the supply voltage VDD and the voltage between the drain and the source of the transistor M6, that is:

$$Vr=V_{DD}-|VdsM6|=V_{DD}-I\cdot R1+VgsM6 \quad (2)$$

From expressions (1) and (2):

$$I(R1+R2)=V_{DD}+VgsM6-VgsM7,$$

from which:

$$I=\frac{V_{DD}+VgsM6-VgsM7}{R1+R2} \text{ and} \quad (3)$$

$$Vr=\frac{R2}{R1+R2}(V_{DD}+VgsM6-VgsM7)+VgsM7 \quad (4)$$

As can be seen, the current I of expression (3) and the voltage Vr of expression (4) depend on the gate-source voltages of two MOS transistors, one with an n channel and the other with a p channel, and therefore take account of the deviations from the design values due to the variability of the manufacturing parameters. The voltage Vr can be used, in the integrated device which includes the above-described voltage-generator circuit, as a reference or biasing quantity which adapts automatically to the characteristics of each specimen of the integrated device.

The voltages Vb1, Vb2 picked up at the gate terminals of the transistors M7 and M6 can be used as biasing voltages for two MOS transistors with an n channel and a p channel, respectively, having load resistors. The drain current of each of the two transistors brings about a voltage drop in the load resistor which also follows the process variations. This voltage will in fact depend substantially on the term VDD–(VgsM7+VgsM6) and on the scale ratios which, as is known, can be determined by modifying the width/length (W/L) ratios of the channels of the transistors and the values of the load resistors used.

The voltages Vb3 and Vb4 picked up at the gate terminals of the transistors M3 and M2 can be used as biasing voltages for n-channel and p-channel MOS transistors, respectively, to generate currents proportional to the current I of expression (3).

Various voltages are thus obtained, which can be used as reference and/or biasing voltages in the integrated device in which the generator according to the invention is formed and which adapt automatically to the actual values of the electrical parameters that are dependent on the manufacturing process. It will be noted that these voltages also adapt to temperature variations since the Vgs voltages on which they depend vary with temperature.

Figure 2:
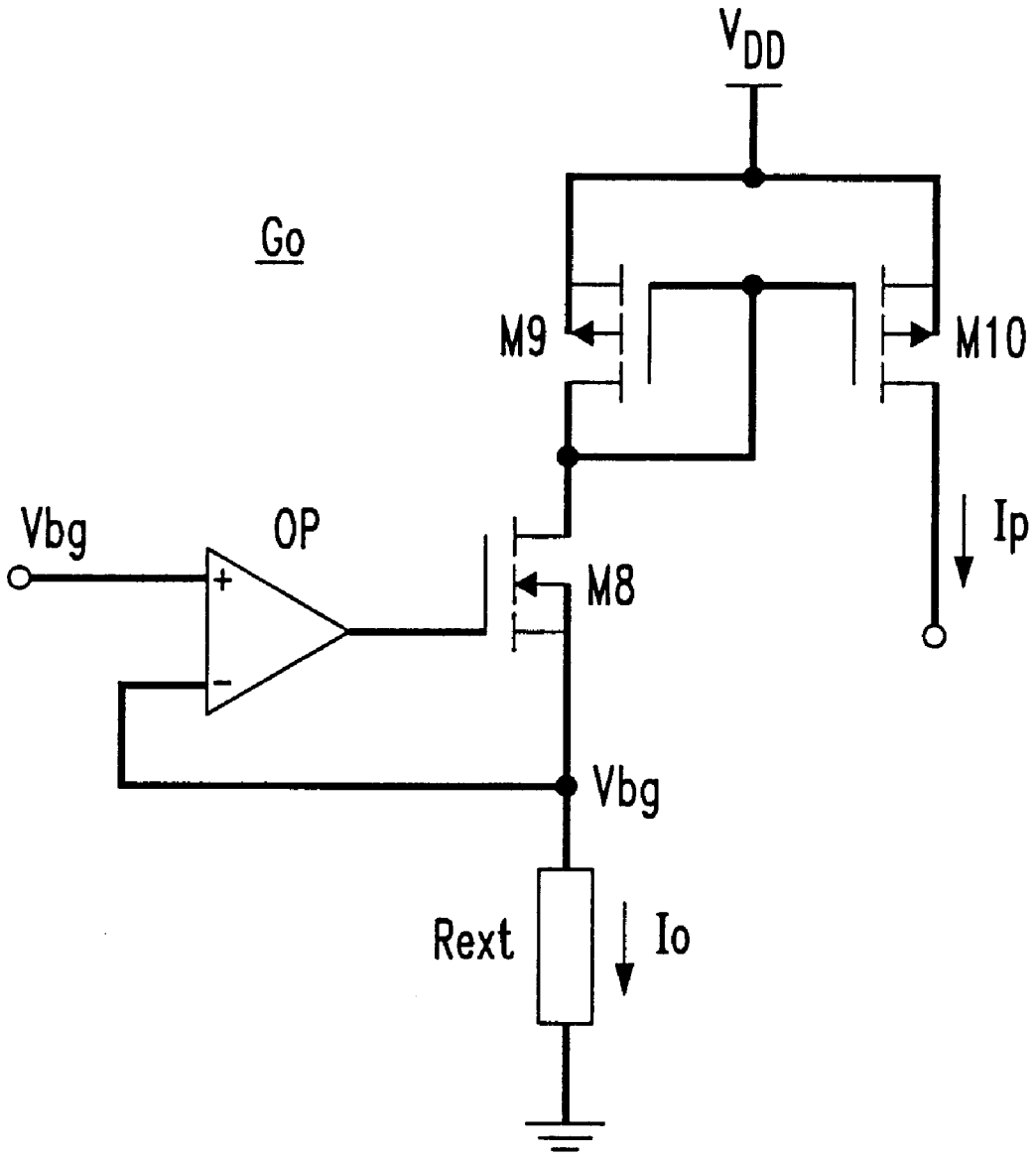
FIG. 2 is a circuit diagram of a current generator for use with the circuit of FIG. 1.

As shown in FIG. 2, the generator Go may include an operational amplifier OP having its non-inverting input terminal connected to a source (not shown) of a reference voltage Vbg which is constant and independent of temperature, for example, a source referenced to the conduction band of silicon (a band-gap referenced voltage source). The output of the operational amplifier OP is connected to the gate terminal of an n-channel MOS transistor M8. The transistor M8 has its source terminal connected to the inverting input terminal of the amplifier OP and, via a resistor Rext, to the ground terminal, and has its drain terminal connected to the drain terminal of a p-channel MOS transistor M9. The transistor M9 has its source terminal connected to the supply terminal VDD, and its gate terminal connected to its own drain terminal and to the gate terminal of another p-channel MOS transistor M10. The latter has its source terminal connected to the supply terminal VDD and its drain terminal connected to the node A of the circuit of FIG. 1.

In operation, the voltage at the inverting input of the amplifier OP is brought to the voltage of the non-inverting input. The resistor Rext therefore has the voltage Vbg at its terminals and a current Io=Vbg/Rext passes through it. This resistor is preferably a very precise, discrete component so that the current Io can be set correspondingly precisely. Moreover, it is independent of temperature, as is the voltage Vbg. The transistors M9 and M10 are connected as a current mirror so that the current Ip which passes through the transistor M10 and is forced at the node A is equal to the current Io if the transistors M9 and M10 have the same dimensions, or is proportional thereto in accordance with the dimensional ratios between the two transistors if they have different dimensions. In any case, the current Ip is a current which can be set very precisely and is independent of temperature.

Although only one embodiment of the invention has been described and illustrated, naturally many modifications and variations are possible within the scope of the same inventive concept. For example, p-channel MOS transistors could be used instead of the n-channel MOS transistors and vice versa, with the polarity of the supply voltage reversed, or the dimensional ratios between the transistors could be different so that the currents in the second and third circuit branches would differ from one another although they would be proportional to the current I of expression (3).

That which is claimed is:

1. A voltage generator comprising:

a first voltage supply terminal and a second voltage supply terminal;

a first circuit branch comprising a constant-current generator, a first MOS transistor having a channel with a first type of conductivity and having a source-drain path in series with the constant-current generator between the first voltage supply terminal and the second voltage supply terminal, and a junction node between the first transistor and the constant-current generator;

a second circuit branch comprising a second MOS transistor having a channel with a second type of conductivity, and a third MOS transistor having a channel with the first type of conductivity, the second and third MOS transistors having drain terminals in common and having source terminals connected to the first voltage supply terminal and to the second voltage supply terminal, respectively, the second transistor having a gate terminal connected to the junction node between the first transistor and the constant-current generator, and the third transistor having a gate terminal connected to its own drain terminal;

a third circuit branch comprising a fourth MOS transistor having a channel with the second type of conductivity, and a fifth MOS transistor having a channel with the first type of conductivity, the fourth and fifth MOS transistors having drain terminals connected to one another via two resistors connected in series through a second junction node, a gate terminal of the fourth MOS transistor being connected to the junction node between the first transistor and the constant-current generator, a gate terminal of the fifth MOS transistor being connected to the gate terminal of the third transistor, and the drain terminal of the fifth MOS transistor being connected to the gate terminal of the first transistor; and a fourth circuit branch comprising a sixth MOS transistor having a channel with the second type of conductivity, and a seventh MOS transistor having a channel with the first type of conductivity, the sixth and seventh transistors having drain terminals connected together to the second junction node between the two resistors and gate terminals connected to the drain terminal of the fourth MOS transistor and to the drain terminal of the fifth MOS transistor, respectively;

each of the gate terminals of the second transistor, the third transistor, the sixth transistor, and the seventh transistor, and the second junction node between the two resistors defining output terminals of the voltage generator.

2. A voltage generator according to claim 1 wherein the constant-current generator generates a current of predetermined value independent of process variations and of temperature.

3. A voltage generator according to claim 1 wherein the first type of conductivity is an n-type conductivity and the second type of conductivity is a p-type conductivity.

4. A voltage generator comprising:

a first voltage supply and a second voltage supply;

a first circuit branch comprising a constant-current generator, a first transistor having a source-drain path in series with the constant-current generator between the first voltage supply and the second voltage supply;

a second circuit branch comprising a second transistor and a third transistor having drains in common and having sources connected to the first voltage supply and to the second voltage supply, respectively, the second transistor having a gate connected between the first transistor and the constant-current generator, and the third transistor having a gate and a drain connected together;

a third circuit branch comprising a fourth transistor and a fifth transistor having drains connected to one another via two resistors connected in series through a junction, a gate of the fourth transistor being connected between the first transistor and the constant-current generator, a gate of the fifth transistor being connected to the gate of the third transistor, and the drain of the fifth transistor being connected to a gate of the first transistor;

a fourth circuit branch comprising a sixth transistor and a seventh transistor having drains connected together to the junction between the two resistors, and gates connected to the drain of the fourth transistor and to the drain of the fifth transistor, respectively; and voltage generator outputs defined by the gate of the second transistor, the gate of the third transistor, the gate of the sixth transistor, the gate of the seventh transistor, and the junction between the two resistors.

5. A voltage generator according to claim 4 wherein the constant-current generator generates a current of predetermined value independent of process variations and of temperature.

6. A voltage generator according to claim 4 wherein the first transistor has a channel with a first type of conductivity, the second transistor has a channel with a second type of conductivity, the third transistor has a channel with the first type of conductivity, the fourth transistor has a channel with the second type of conductivity, the fifth transistor has a channel with the first type of conductivity, the sixth transistor has a channel with the second type of conductivity, and the seventh transistor has a channel with the first type of conductivity.

7. A voltage generator according to claim 6 wherein the first type of conductivity is an n-type conductivity and the second type of conductivity is a p-type conductivity.

8. An integrated circuit comprising:

a voltage generator comprising a first voltage supply terminal and a second voltage supply terminal;

a first circuit branch comprising a constant-current generator, a first MOS transistor having a channel with a first type of conductivity and having a source-drain path in series with the constant-current generator between the first voltage supply terminal and the second voltage supply terminal, and a junction node between the first transistor and the constant-current generator;

a second circuit branch comprising a second MOS transistor having a channel with a second type of conductivity, and a third MOS transistor having a channel with the first type of conductivity, the second and third MOS transistors having drain terminals in common and having source terminals connected to the first voltage supply terminal and to the second voltage supply terminal, respectively, the second transistor having a gate terminal connected to the junction node between the first transistor and the constant-current generator, and the third transistor having a gate terminal connected to its own drain terminal;

a third circuit branch comprising a fourth MOS transistor having a channel with the second type of conductivity, and a fifth MOS transistor having a channel with the first type of conductivity, the fourth and fifth MOS transistors having drain terminals connected to one another via two resistors connected in series through a second junction node, a gate terminal of the fourth MOS transistor being connected to the junction node between the first transistor and the constant-current generator, a gate terminal of the fifth MOS transistor being connected to the gate terminal of the third transistor, and the drain terminal of the fifth MOS transistor being connected to the gate terminal of the first transistor; and a fourth circuit branch comprising a sixth MOS transistor having a channel with the second type of conductivity, and a seventh MOS transistor having a channel with the first type of conductivity, the sixth and seventh transistors having drain terminals connected together to the second junction node between the two resistors and gate terminals connected to the drain terminal of the fourth MOS transistor and to the drain terminal of the fifth MOS transistor, respectively;

each of the gate terminals of the second transistor, the third transistor, the sixth transistor, and the seventh transistor, and the second junction node between the two resistors defining output terminals of the voltage generator.

9. An integrated circuit according to claim 8 wherein the constant-current generator generates a current of predetermined value independent of process variations and of temperature.

10. An integrated circuit according to claim 8 wherein the first type of conductivity is an n-type conductivity and the second type of conductivity is a p-type conductivity.

11. An integrated circuit comprising:

a voltage generator comprising a first voltage supply and a second voltage supply;

a first circuit branch comprising a constant-current generator, a first transistor having a source-drain path in series with the constant-current generator between the first voltage supply and the second voltage supply;

a second circuit branch comprising a second transistor and a third transistor having drains in common and having sources connected to the first voltage supply and to the second voltage supply, respectively, the second transistor having a gate connected between the first transistor and the constant-current generator, and the third transistor having a gate and a drain connected together;

a third circuit branch comprising a fourth transistor and a fifth transistor having drains connected to one another via two resistors connected in series through a junction, a gate of the fourth transistor being connected between the first transistor and the constant-current generator, a gate of the fifth transistor being connected to the gate of the third transistor, and the drain of the fifth transistor being connected to a gate of the first transistor;

a fourth circuit branch comprising a sixth transistor and a seventh transistor having drains connected together to the junction between the two resistors, and gates connected to the drain of the fourth transistor and to the drain of the fifth transistor, respectively; and voltage generator output terminals defined by the gate of the second transistor, the gate of the third transistor, the gate of the sixth transistor, the gate of the seventh transistor, and the junction between the two resistors.

12. An integrated circuit according to claim 11 wherein the constant-current generator generates a current of predetermined value independent of process variations and of temperature.

13. An integrated circuit according to claim 11 wherein the first transistor has a channel with a first type of conductivity, the second transistor has a channel with a second type of conductivity, the third transistor has a channel with the first type of conductivity, the fourth transistor has a channel with the second type of conductivity, the fifth transistor has a channel with the first type of conductivity, the sixth transistor has a channel with the second type of conductivity, and the seventh transistor has a channel with the first type of conductivity.

14. An integrated circuit according to claim 13 wherein the first type of conductivity is an n-type conductivity and the second type of conductivity is a p-type conductivity.

15. A method of making a voltage generator comprising:

forming a first circuit branch comprising a constant-current generator, a first transistor having a source-drain path in series with the constant-current generator between a first voltage supply and a second voltage supply;

forming a second circuit branch comprising a second transistor and a third transistor having drains in common and having sources connected to the first voltage supply and to the second voltage supply, respectively, the second transistor having a gate connected between the first transistor and the constant-current generator, and the third transistor having a gate and a drain connected together;

forming a third circuit branch comprising a fourth transistor and a fifth transistor having drains connected to one another via two resistors connected in series through a junction, a gate of the fourth transistor being connected between the first transistor and the constant-current generator, a gate of the fifth transistor being connected to the gate of the third transistor, and the drain of the fifth transistor being connected to a gate of the first transistor;

forming a fourth circuit branch comprising a sixth transistor and a seventh transistor having drains connected together to the junction between the two resistors, and gates connected to the drain of the fourth transistor and to the drain of the fifth transistor, respectively; and defining voltage generator outputs as the gate of the second transistor, the gate of the third transistor, the gate of the sixth transistor, the gate of the seventh transistor, and the junction between the two resistors.

16. A method according to claim 15 wherein the constant-current generator generates a current of predetermined value independent of process variations and of temperature.

17. A method according to claim 15 wherein the first transistor has a channel with a first type of conductivity, the second transistor has a channel with a second type of conductivity, the third transistor has a channel with the first type of conductivity, the fourth transistor has a channel with the second type of conductivity, the fifth transistor has a channel with the first type of conductivity, the sixth transistor has a channel with the second type of conductivity, and the seventh transistor has a channel with the first type of conductivity.

18. A method according to claim 17 wherein the first type of conductivity is an n-type conductivity and the second type of conductivity is a p-type conductivity.

* * * * *

UNITED STATES PATENT AND TRADEMARK OFFICE

CERTIFICATE OF CORRECTION

PATENT NO. : 6,392,471 B1 
DATED : May 21, 2002
INVENTOR(S) : Luciano Tomasini, Jesus Guinea and Rinaldo Castello It is certified that error appears in the above-identified patent and that said Letters Patent is hereby corrected as shown below:

Title page,
Item [30], Foreign Application Priority Data, insert
-- [30] Foreign Application Priority Data
Jan. 20, 2000 (IT) …….. RM2000A000032 --

Signed and Sealed this

Third Day of December, 2002

JAMES E. ROGAN
*Director of the United States Patent and Trademark Office*